US009540908B1

(12) United States Patent
Olivier

(10) Patent No.: US 9,540,908 B1
(45) **Date of Patent: *Jan. 10, 2017**

(54) CONTAINMENT WORK PLATFORM WITH PROTRUDING CONNECTION

(71) Applicant: INTEGRIS RENTALS, L.L.C., Houma, LA (US)

(72) Inventor: Pierre L. Olivier, Houma, LA (US)

(73) Assignee: Integris Rentals, L.L.C., Houma, LA (US)

( * ) Notice: Subject to any disclaimer, the term of this patent is extended or adjusted under 35 U.S.C. 154(b) by 30 days.

This patent is subject to a terminal disclaimer.

(21) Appl. No.: 13/659,651

(22) Filed: Oct. 24, 2012

Related U.S. Application Data

(63) Continuation of application No. 12/240,136, filed on Sep. 29, 2008, now Pat. No. 8,302,736.

(60) Provisional application No. 61/022,499, filed on Jan. 21, 2008, provisional application No. 60/976,212, filed on Sep. 28, 2007.

(51) Int. Cl.
*E21B 41/00* (2006.01)
*E04G 3/24* (2006.01)

(52) U.S. Cl.
CPC ..... *E21B 41/00* (2013.01); *E04G 3/24* (2013.01)

(58) Field of Classification Search
CPC ..... E04G 1/36; E04G 1/362; E04G 3/24; E04G 3/243; B63B 35/44; B63B 35/4413; E21B 15/00; E21B 41/00; E21B 41/0035; E21B 41/005; E21B 7/026
USPC ..... 182/51, 128, 187, 222, 223; 405/195.1, 405/207
See application file for complete search history.

(56) References Cited

U.S. PATENT DOCUMENTS

| | | | | | |
|---|---|---|---|---|---|
| 1,493,091 | A | * | 5/1924 | Wiggins | 220/218 |
| 2,043,128 | A | * | 6/1936 | Sutton | 182/150 |
| 3,299,846 | A | * | 1/1967 | Jarlan | 114/264 |
| 3,490,406 | A | * | 1/1970 | O'Reilly et al. | 114/265 |
| 3,657,895 | A | * | 4/1972 | Phelps | 405/210 |
| 4,372,757 | A | * | 2/1983 | Favret, Jr. | 210/776 |
| 4,407,392 | A | * | 10/1983 | Lazzari | 182/128 |
| 4,429,764 | A | * | 2/1984 | Park | 182/129 |
| 4,780,026 | A | * | 10/1988 | Gunderson | 405/224 |
| 4,852,687 | A | * | 8/1989 | Hittler | 182/129 |
| 5,181,799 | A | * | 1/1993 | Carruba | 405/195.1 |
| 5,203,410 | A | * | 4/1993 | Cobb et al. | 166/95.1 |
| 5,295,557 | A | * | 3/1994 | Taylor | 182/222 |
| 5,498,107 | A | * | 3/1996 | Schatzle, Jr. | 405/224 |
| 5,823,132 | A | * | 10/1998 | Donavon | 114/266 |

(Continued)

*Primary Examiner* — Colleen M Chavchavadze

(74) *Attorney, Agent, or Firm* — Garvey, Smith, Nehrbass & North, L.L.C.; Seth M. Nehrbass; Charles C. Garvey, Jr.

(57) ABSTRACT

A support platform for enabling a worker to service an oil well next to a wellhead having a valve tree includes:

a) a platform having an upper floor, a lower floor and a cellar in between the floors;

b) a platform having a periphery, a central opening and radially extending beams;

c) a plurality of walls attached to the periphery of the platform, said beams connecting to said walls below said upper floor;

d) a drain that enables fluid to drain from the upper floor to the lower floor;

e) a coupler that spans between the floors for enabling a connection to be made between the platform and valve tree; and f) a liquid guard or other provision that disallows the escape of fluid from a floor via the central opening.

31 Claims, 8 Drawing Sheets

(56) References Cited

U.S. PATENT DOCUMENTS

| | | | | |
|---|---|---|---|---|
| 5,954,305 | A * | 9/1999 | Calabro | 248/219.4 |
| 6,226,955 | B1 * | 5/2001 | Lorrigan | 52/745.05 |
| 6,681,894 | B1 * | 1/2004 | Fanguy | 182/113 |
| 6,779,614 | B2 * | 8/2004 | Oser | 175/85 |
| 6,830,127 | B2 * | 12/2004 | Johnson | 182/113 |
| 6,848,539 | B2 * | 2/2005 | Lee et al. | 182/128 |
| 7,228,939 | B1 * | 6/2007 | Prater | 182/141 |
| 2003/0209388 | A1 * | 11/2003 | Arsenault et al. | 182/187 |
| 2004/0011592 | A1 * | 1/2004 | Lee et al. | 182/187 |
| 2009/0095569 | A1 * | 4/2009 | Cooper et al. | 182/187 |

* cited by examiner

CONTAINMENT WORK PLATFORM WITH PROTRUDING CONNECTION

CROSS-REFERENCE TO RELATED APPLICATIONS

This is a continuation of my patent application number 12/240,136, filed 29 Sep. 2008, and incorporated herein by reference.

My provisional patent application Ser. No. 60/976,212, filed 28 Sep. 2007, is incorporated herein by reference.

My provisional patent application Ser. No. 61/022,499, filed 21 Jan. 2008, is incorporated herein by reference.

Priority of both of these applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the servicing of oil and gas wells. More particularly, the present invention relates to an improved work platform that can be removably fitted to the wellhead area of an oil and gas well.

2. General Background of the Invention

The wellhead area of an oil and gas well typically provides a valve tree or "Christmas" tree. This wellhead valve tree is an assembly of pipes, valves and/or fittings. It is typically positioned at the location of the entry of the well into the earth or seabed.

Many types of remedial actions are carried out by positioning workers at or near a wellhead area or valve tree. Thus, there exists a need for a platform that can be positioned next to or upon a valve tree for supporting one or more workers that are engaged in remedial activity.

The following U.S. Patents are incorporated herein by reference:

TABLE

| Pat. No. | TITLE | ISSUE DATE |
|---|---|---|
| 4,085,796 | Well Tubing Handling System | Apr. 25, 1978 |
| 4,085,798 | Method for Investigating the Front Profile During Flooding of Formations | Apr. 25, 1978 |
| 4,515,220 | Apparatus and Method for Rotating Coil Tubing in a Well | May 7, 1985 |
| 4,842,446 | Offshore Support Structure Methods and Apparatus | Jun. 27, 1989 |
| 5,094,568 | Offshore Support Structure Method and Apparatus | Mar. 10, 1992 |
| 5,181,799 | Offshore Support Structure Apparatus | Jan. 26, 1993 |
| 5,203,410 | Blowout Safety System for Snubbing Equipment | Apr. 20, 1993 |
| 5,295,557 | Utility Construction Safety and Work Platform | Mar. 22, 1994 |
| 5,498,107 | Apparatus and Method for Installing Cabled Guyed Caissons | Mar. 12, 1996 |
| 5,954,305 | Adaptable Antenna Mounting Platform for Fixed Securement to an Elongated Mast Pole | Sep. 21, 1999 |
| 6,226,955 | Method and Apparatus for Handling Building Materials and Implements | May 8, 2001 |
| 6,681,894 | Portable Well Head Work Platform | Jan. 27, 2004 |

TABLE-continued

| Pat. No. | TITLE | ISSUE DATE |
|---|---|---|
| 6,779,614 | System and Method for Transferring Pipe | Aug. 24, 2004 |
| 6,830,127 | Pipeline Construction Safety Platform | Dec. 14, 2004 |
| 6,848,539 | Work Platform for Blowout Preventer Stacks | Feb. 1, 2005 |
| 2005/0129464 | Motion Compensation System and Method | Jun. 16, 2005 |

BRIEF SUMMARY OF THE INVENTION

The present invention provides a support platform for enabling a worker to service an oil well next to the wellhead area of the oil and gas well, the wellhead area typically providing a valve tree.

The apparatus includes a platform having an upper floor, a lower floor and a cellar in between the floors.

The platform provides a periphery, a central opening and radially extending beams that are attached to the floors for reinforcing same. A plurality of walls are attached to the periphery of the platform, the beams connecting to the walls below the upper floor.

A drain enables fluid to drain from the upper floor to the lower floor and into the cellar or reservoir. A coupler spans between the floors and enables a connection to be made between the platform and the valve tree.

The connector can include a liquid guard that disallows escape of fluid from the floor via the central opening.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
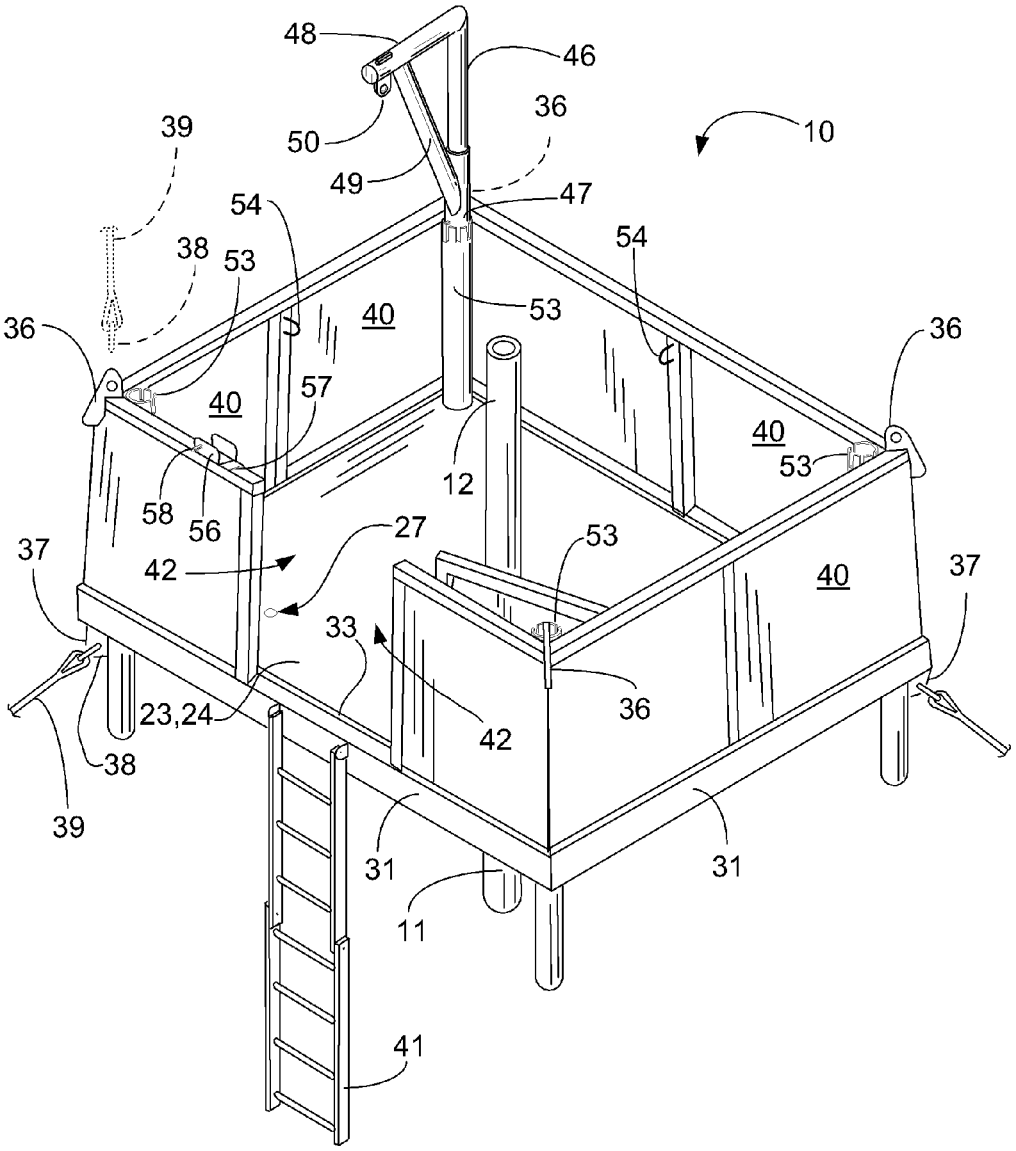
FIG. 1 is a perspective view of a preferred embodiment of the apparatus of the present invention showing the access door in an open position.
Figure 2:
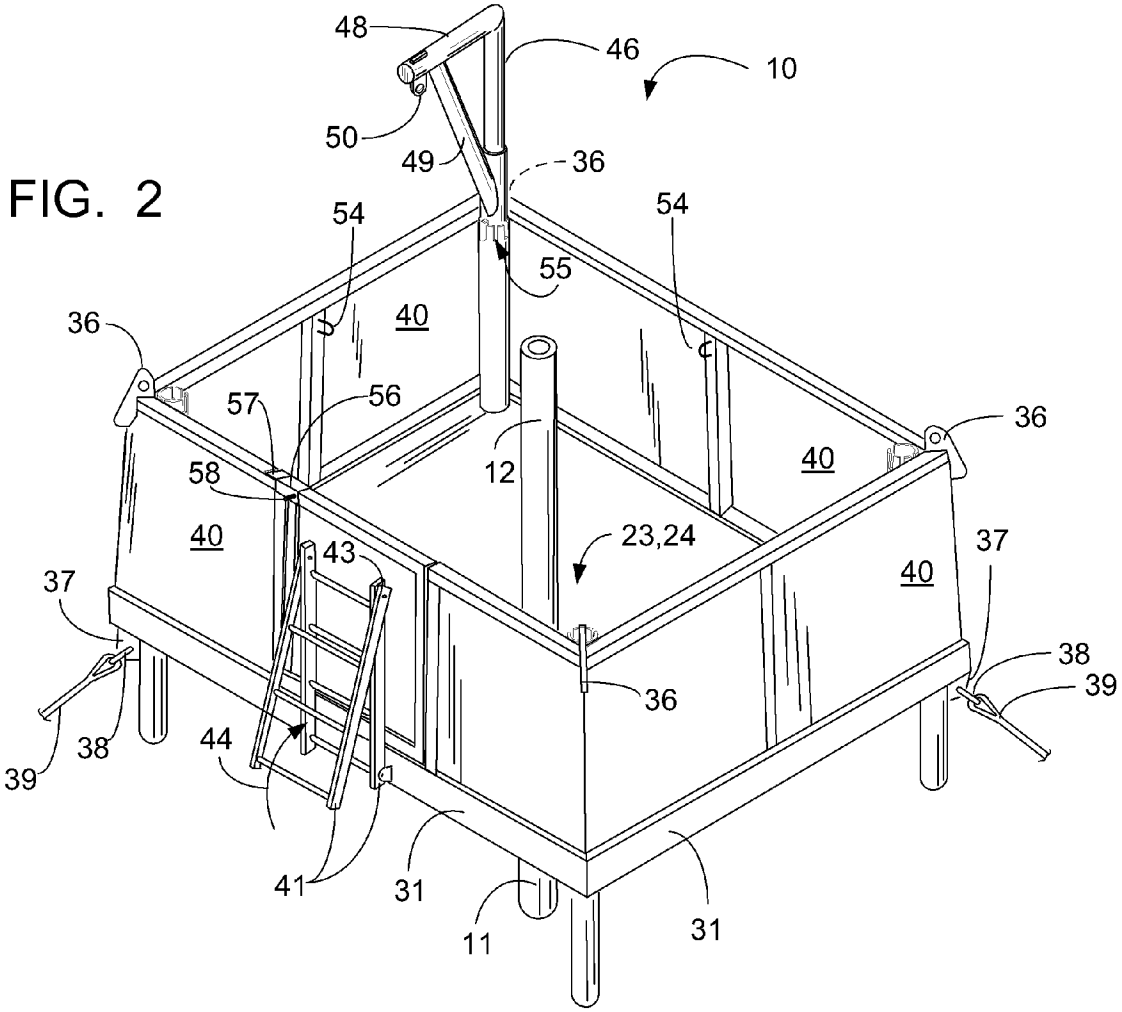
FIG. 2 is a perspective view of the preferred embodiment of the apparatus of the present invention showing the access door in a closed position.
Figure 3:
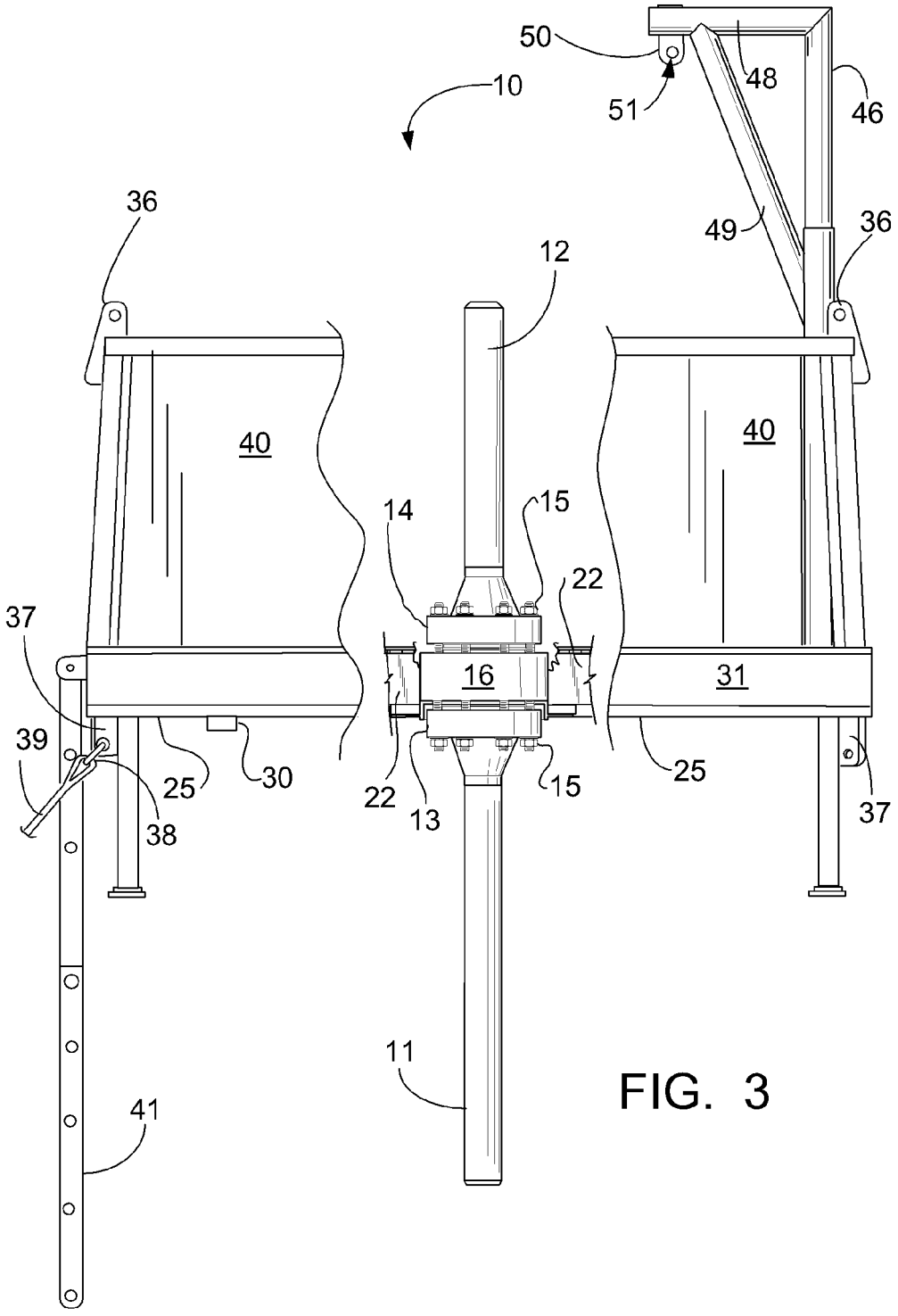
FIG. 3 is a sectional, partially cut-away view of the preferred embodiment of the apparatus of the present invention.

FIGS. 1-7 show a preferred embodiment of the apparatus of the present invention, designated generally by the numeral 10 in FIGS. 1-3. Wellhead servicing platform 10 provides a structure that can be attached to a wellhead area such as a valve tree or the riser section of the valve tree. In FIGS. 1-3, the riser section can include riser sections 11, 12. Each riser section can be fitted with an annular pipe flange. The riser section 11 has annular pipe flange 13. The riser section 12 has annular pipe flange 14.

Each annular pipe flange 13, 14 can be connected to annular flange 16 using one or more bolted connections 15. The annular flange 16 provides a flange central opening 17 that enables communication to flow from one riser section 11 to the other riser section 12 via central opening 17.

Figure 4:
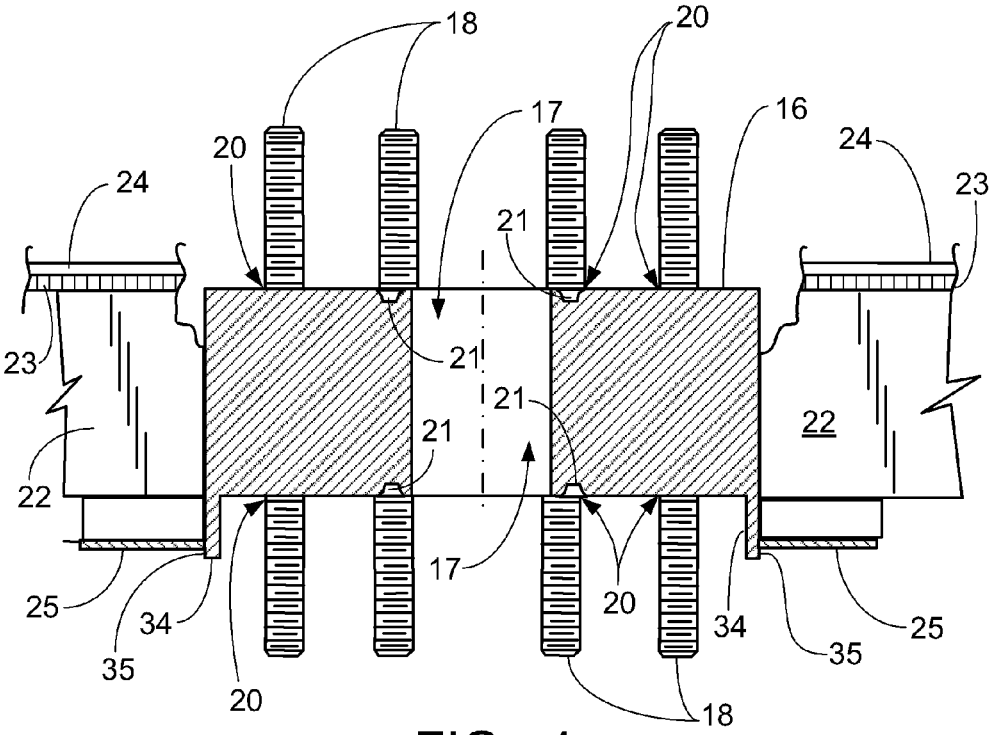
FIG. 4 is a detailed fragmentary view of the preferred embodiment of the apparatus of the present invention.
Figure 7:
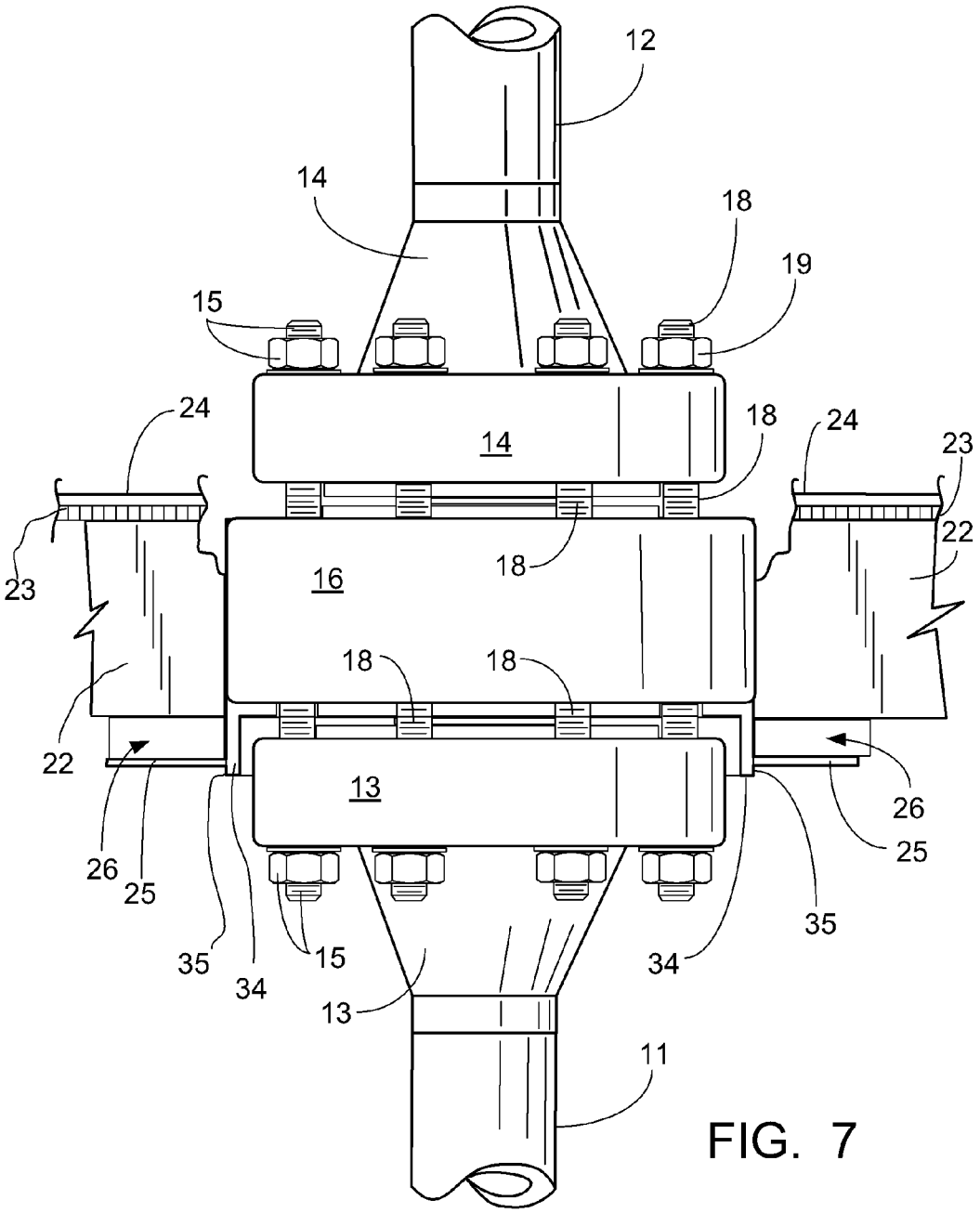
FIG. 7 is a sectional view taken along lines 7-7 of FIG. 6.

Bolted connection 15 can employ a plurality of threaded studs 18, each fitted with a plurality of nuts 19 as shown in FIGS. 3, 4 and 7. Flange 16 provides a plurality of openings 20, each opening 20 being receptive of a threaded stud 18. The openings 20 align with correspondingly sized and shaped openings of the flanges 13, 14. The flange 16 can be provided with annular grooves 21 that can be fitted with sealing members such as sealing rings or gaskets.

Figure 5:
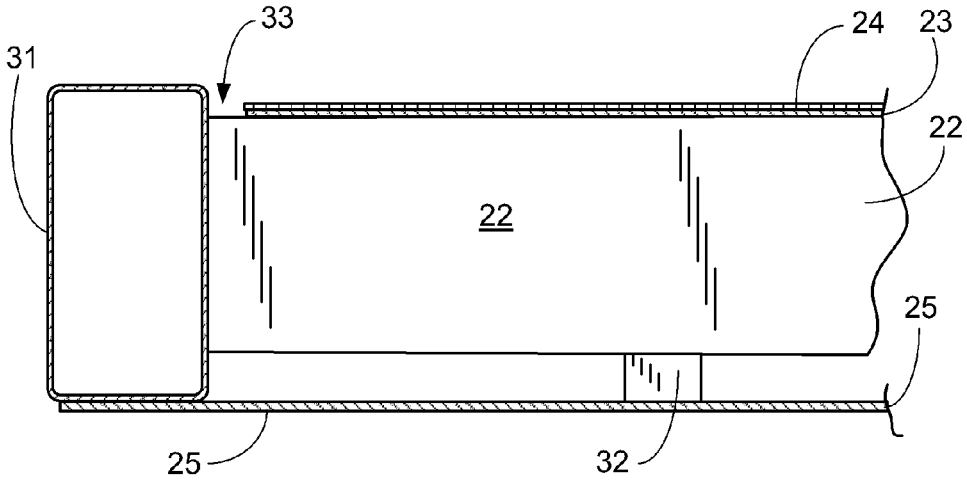
FIG. 5 is a fragmentary sectional view of the preferred embodiment of the apparatus of the present invention.
Figure 6:
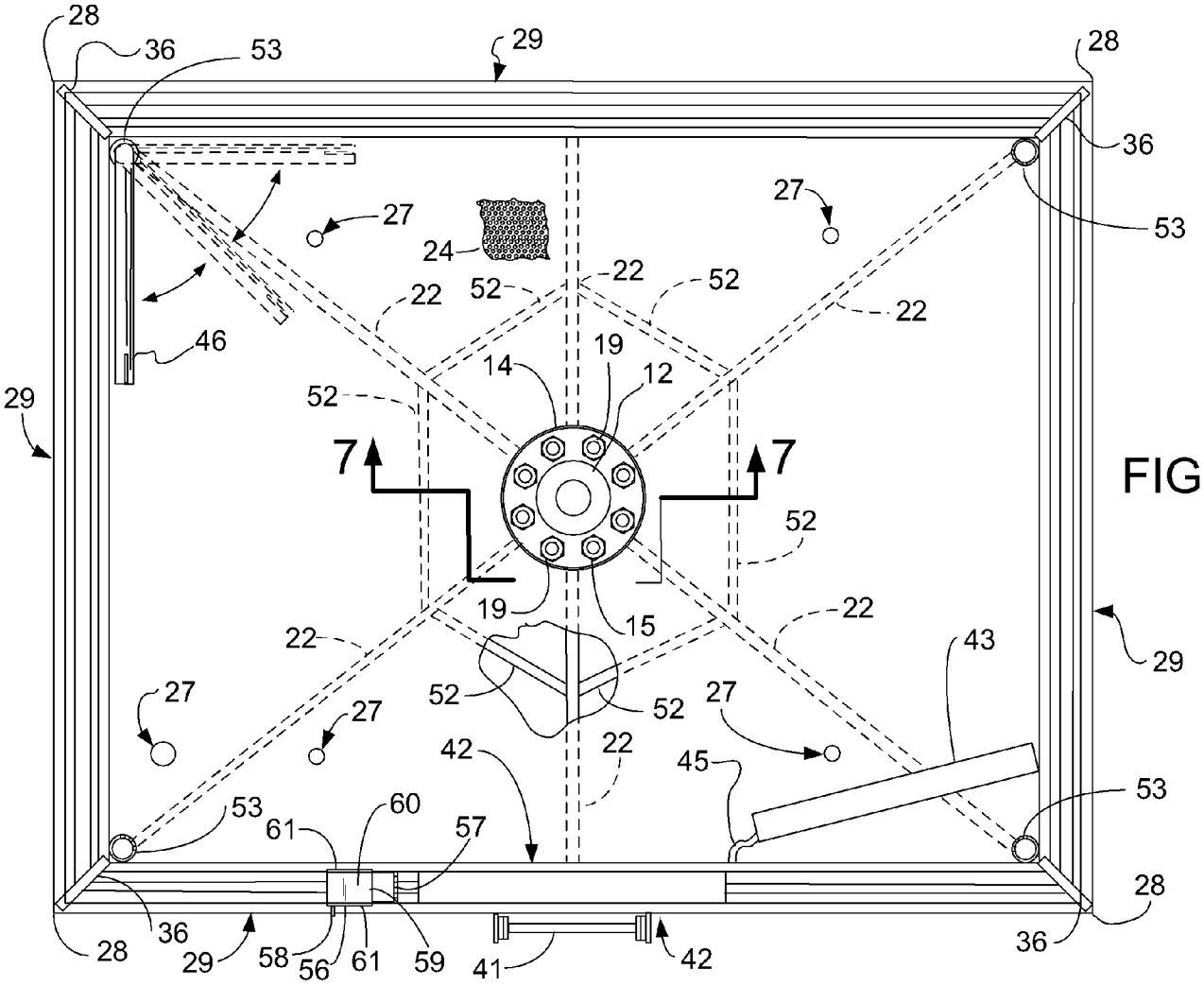
FIG. 6 is a plan view of the preferred embodiment of the apparatus of the present invention.

A plurality of radially extending beams 22 are fastened at one end portion to flange 16 and at their opposing end portions to the periphery 29 of platform 10. Circumferentially extending stiffener plates 52 can be placed in between and connected to each pair of beams 22 (see FIG. 6). At the platform periphery 29 there are provided peripheral beams 31 as shown in FIGS. 1 and 5. Upper floor 23 can be connected to the upper surface of beams 22. Lower floor 25 can be connected to peripheral beams 31 and to radially extending beams 22 using stiffener plates 32. The construction of beams 22, 31 and floors 23, 25 can be welded aluminum or like construction. Upper floor 23 can be provided with a perforated plate layer 24 for traction purposes (see FIGS. 4-6). Perforated plate layer 24 can be tack welded to floor 23. As can be seen in FIG. 6, beams 22 are interior beams. As can be seen in FIGS. 1-5, beams 31 are peripheral beams.

A reservoir or cellar 26 is provided in between upper floor 23 and lower floor 25. The reservoir/cellar 26 receives any fluid flow that spills upon upper floor 23 and flows via drains 27 or drainage slot 33 (FIG. 5) during work over or other repair or maintenance operations. A drain/valve 30 can be used for removing fluid that is collected in reservoir/cellar 26.

Platform 10 provides platform corners 28 (FIG. 6). At least some of the radially extending beams 22 connect to a platform corner 28 as shown in FIG. 6. Annular skirt 34 extends downwardly from annular flange 16 as shown in FIG. 4. Lower floor 25 can be attached to annular skirt 34 at its lower end portion 35.

Platform 10 can be provided with a plurality of lifting lugs 36 and a plurality of tie back lugs 37. For lifting the platform 10 such as during placement, the lifting lugs 36 can be fitted with shackles 38 and slings 39 or other suitable rigging for enabling a crane or other lifting device to lift and place platform 10. Such shackles 38 and slings 39 can also be attached to lugs 37.

Platform 10 is provided with a plurality of sidewalls 40. A folding ladder 41 can be provided below entry 42 which is fitted with a door 43. Ladder 41 can be opened and closed as indicated by arrow 44. Ladder 41 shown in FIG. 2, for example, is a two-section folding ladder. Ladder 41 could be replaced with another ladder with more sections, such as five sections, for example. Door 43 can be attached to one of the sidewalls 40 using a hinge 45.

Sidewalls 40 form a dam around upper floor 23. Perimeter beams 31 and sidewalls 40 together form walls (as shown for example in FIG. 1) to which perimeter beams 22 are connected below upper floor 23 (as shown in FIG. 5).

Platform 10 can be made of, for example, aluminum, carbon steel or stainless steel. It can be, for example, around 6' wide by 6' long to 12' wide by 12' long. It could be, for example, around 8' by 8', around 8' by 10', or around 12' by 12'. The sidewall 40 can be for example around 3'-6' high, preferably around 3'-5' high, and even more preferably around 3'-4' high.

There is a gooseneck or lifting device 46 which can be received in any of a plurality of provided receivers 53. There is preferably a receiver 53 positioned next to each corner 28 (see FIGS. 1 and 6). Each receiver 53 can be provided with an upper end portion having circumferentially spaced apart vertical slots 55 or notches. A correspondingly sized and shaped lug 62 or projection on column 47 of lifting device 46 would be interlocked with a selected vertical slot of receiver 53 to affix lifting device 46 boom 48 in a selected angular orientation (see arrows 63, FIG. 8). For example, slots 55 or notches could be provided about 30-45 degrees apart. Lifting device 46 includes a column 47 and a boom 48 attached to the top of column 47 as shown. Diagonal brace 49 can be provided, spanning between column 47 and boom 48 as shown. Padeye 50 is attached (e.g. welded) to the boom 48 free end as shown. Preferably suspended from boom 48 padeye 50 at opening 51 is a safety lanyard point. The point could be a padeye 50 as shown to which to connect an antifall device, such as Galvanized Aircraft Cable Retractable Lanyard Item No. 21402 (commercially available from TASCO).

Figure 8:
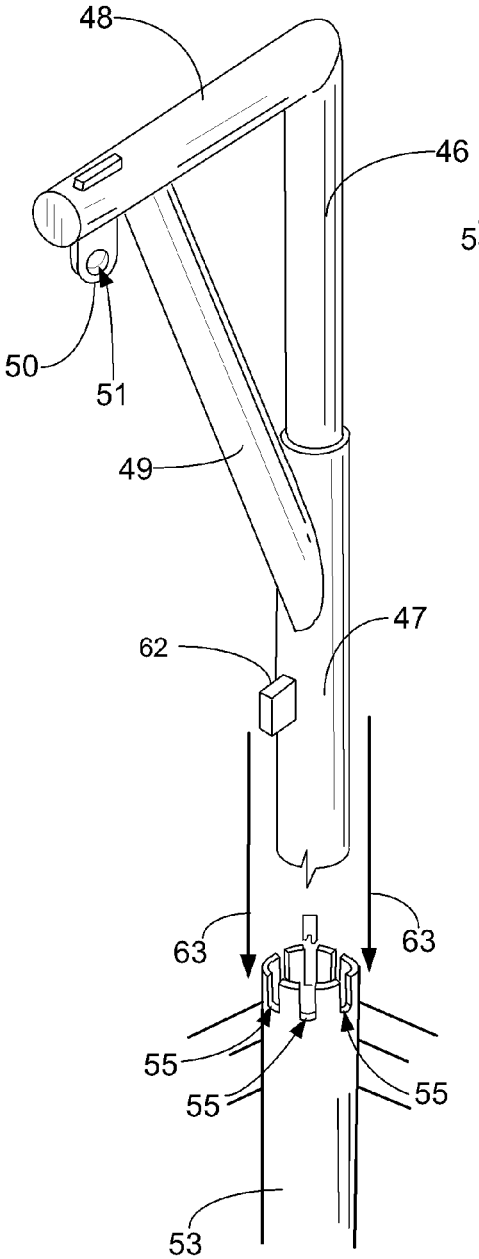
FIG. 8 is a partial perspective view of a preferred embodiment of the apparatus of the present invention.
Figure 9:
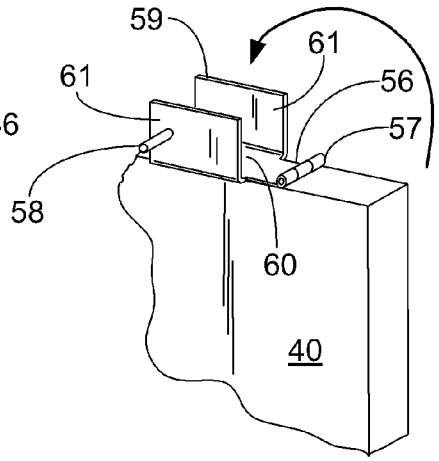
FIG. 9 is a fragmentary view of the preferred embodiment of the apparatus of the present invention showing the door latch in an open position.
Figure 10:
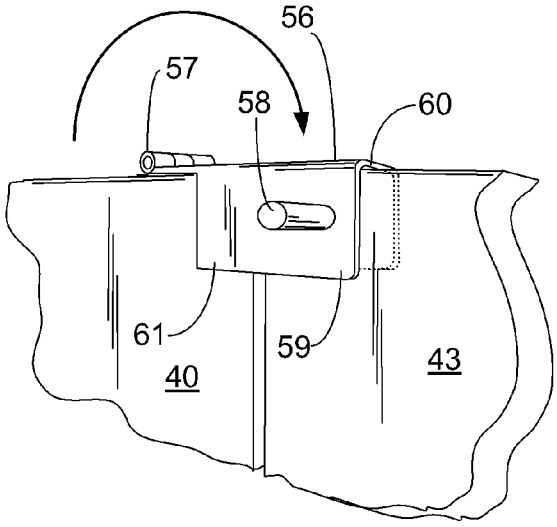
FIG. 10 is a fragmentary view of the preferred embodiment of the apparatus of the present invention showing the door latch in a closed position.

Receiver 53 can have three notches 55 as shown in FIG. 1 or six notches 55 as shown in FIG. 8. In the latter case, the top of receiver 53 preferably extends above the sidewall 40 as shown in FIG. 8 so the lug/projection 62 can be received in the outer notches 55 without contacting sidewall 40. Preferably, the top of receiver 53 is not higher than the center of the shackle eye in lifting lug 36; otherwise, it might interfere with lifting lines connected to lifting lugs 36.

Eyelets or lanyard loops 54 can be positioned at intervals around the periphery of platform 10, such as on each sidewall 40 (see FIG. 1). The eyelets are life line attachment points for enabling a worker to attach his or her harness or safety line thereto to prevent an inadvertent fall.

Latch 56 holds door 43 in a closed position. Latch 56 is pivotally attached using hinge 57 to a sidewall 40 that is next to door 43 as shown in FIGS. 1-2, 6, and 9-10. Latch 56 has a handle 58 for enabling a user to grip and pivot it. Latch 56 employs u-shaped member 59 having web 60 and flanges 61.

Figure 11:
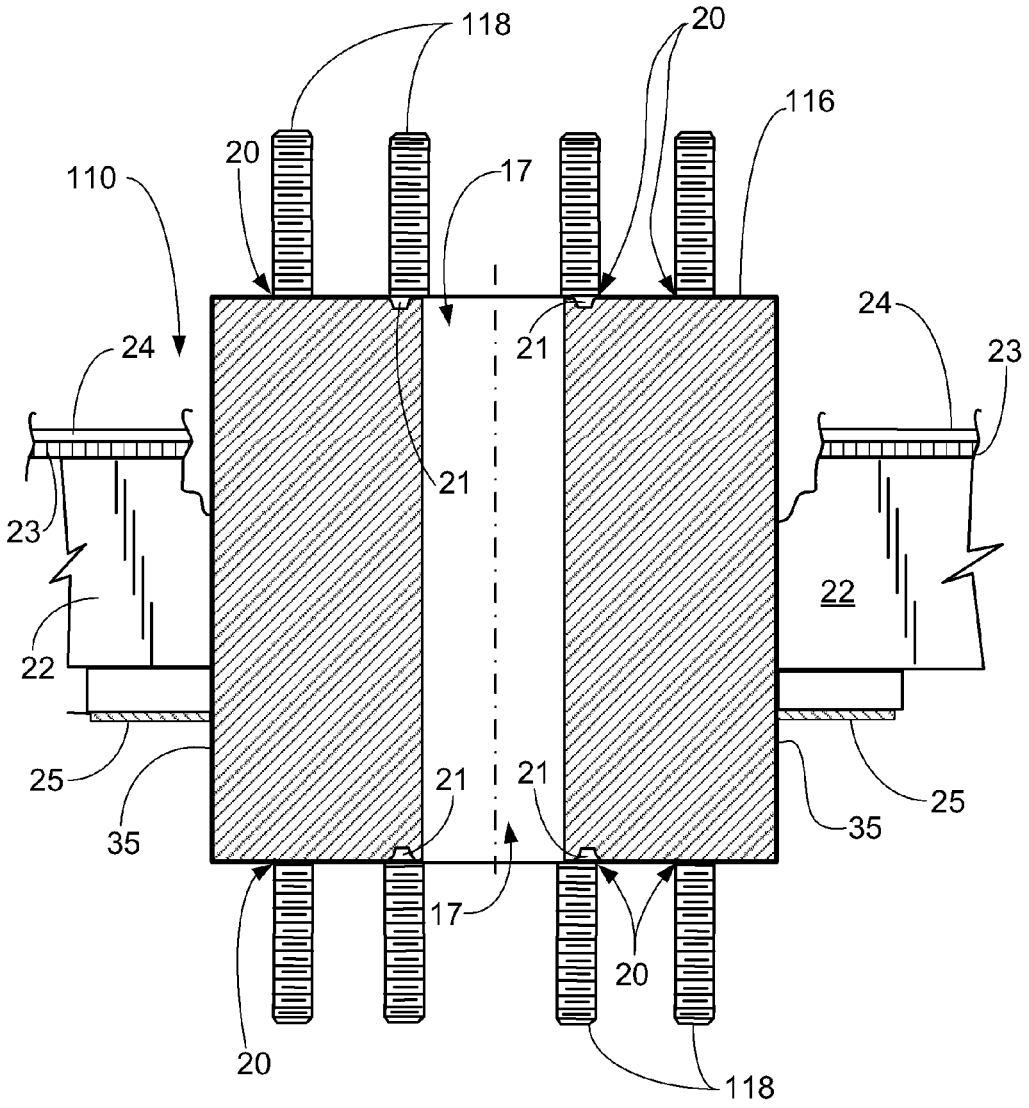
FIG. 11 is a detailed fragmentary view of a preferred embodiment of the apparatus of the present invention, similar to FIG. 4, but showing a preferred coupler member (central annular flange).

FIG. 11 shows a preferred flange 116. Flange 116 preferably extends upwardly from floor 23 preferably about 0.5-24 inches, more preferably about 1-12 inches, even more preferably about 2-10 inches, even more preferably about 2-6 inches, and most preferably about 3 inches. Flange 116 preferably extends downwardly from floor 25 preferably about 0.5-24 inches, more preferably about 1-12 inches, even more preferably about 2-10 inches, even more preferably about 2-6 inches, and most preferably about 3 inches.

Flange 116 makes it easier to connect annular pipe flanges 13 and 14 to platform 110 by providing a protruding connection, as bolts 118 extend further from the floors and thus are easier to see and to line up with pipe flanges 13 and 14. Preferably, flange 116 acts not only as a coupler but also as a liquid guard that disallows the escape of fluid from a floor 23, 25 via the central opening.

As best seen in FIGS. 1-3, sidewalls 40 slant inward toward the center of platform 10.

The following is a list of parts and materials suitable for use in the present invention.

PARTS LIST

| Part Number | Description |
|---|---|
| 10 | wellhead servicing platform |
| 11 | riser section |
| 12 | riser section |
| 13 | annular pipe flange |
| 14 | annular pipe flange |
| 15 | bolted connection |
| 16 | annular flange |
| 17 | flange central opening |
| 18 | threaded stud |
| 19 | nut |
| 20 | opening |
| 21 | annular groove |
| 22 | radially extending beam |
| 23 | upper floor |
| 24 | perforated plate layer |
| 25 | lower floor |
| 26 | reservoir/cellar |
| 27 | drain |
| 28 | platform corner |
| 29 | platform periphery |
| 30 | drain/valve |
| 31 | peripheral beam |
| 32 | stiffener plate |
| 33 | drainage slot |
| 34 | annular skirt (liquid guard) |
| 35 | lower end portion |
| 36 | lifting lug |
| 37 | tie back lug |
| 38 | shackle |
| 39 | sling |
| 40 | sidewall |
| 41 | folding ladder |
| 42 | entry |
| 43 | door |
| 44 | arrow |
| 45 | hinge |
| 46 | lifting device |
| 47 | column |
| 48 | boom |
| 49 | diagonal brace |
| 50 | padeye |
| 51 | opening |
| 52 | stiffener plate |
| 53 | receiver |
| 54 | eyelet/lanyard loop |
| 55 | vertical slot |
| 56 | door latch |
| 57 | hinge |
| 58 | handle |
| 59 | u-shaped member |
| 60 | web |
| 61 | flange |
| 62 | lug/projection |
| 63 | arrow |
| 110 | platform |
| 116 | flange |
| 118 | bolts |

All measurements disclosed herein are at standard temperature and pressure, at sea level on Earth, unless indicated otherwise.

Hereby incorporated herein by reference is information at http://www.integris-rentals.com/containment.php about a commercial embodiment of the present invention.

The foregoing embodiments are presented by way of example only; the scope of the present invention is to be limited only by the following claims.

The invention claimed is:

1. A support platform for enabling a worker to service an oil well next to a wellhead having a valve tree, comprising:

a) a platform having an upper floor, a lower floor and a cellar in between the floors;

b) the platform having a periphery that includes a plurality of platform corners, a central opening having a central vertical axis and a first plurality of radially extending beams, each beam of said first plurality of radially extending beams having an outer end portion connected to a platform corner and an inner end portion;

c) a plurality of walls attached to the periphery of the platform, a second plurality of radially extending beams connecting to said walls below said upper floor;

d) a drain that enables fluid to drain from the upper floor to the lower floor;

e) a coupler that spans between the floors for enabling a connection to be made between the platform and valve tree; and f) a liquid guard that disallows the escape of fluid from a floor via the central opening.

2. The support platform of claim 1 wherein the first plurality of radially extending beams includes at least four radially extending beams, the platform is generally rectangular, having four corners and wherein four beams of the first plurality each extend to a corner.

3. The support platform of claim 2 wherein multiple beams of the second plurality do not extend to the platform corners.

4. The support platform of claim 1 further comprising a valved drain for draining fluids from the cellar.

5. The support platform of claim 1 wherein the walls extend above and below the upper floor.

6. The support platform of claim 5 wherein the platform is generally rectangular, having four corners and wherein each beam of the second plurality extends to a perimeter beam at a position in between two of said corners.

7. The support platform of claim 6 wherein the first and second plurality of radially extending beams include at least four beams, and four beams extend to the corners and some beams do not extend to the corners.

8. The support platform of claim 2 wherein each beam of the first and second pluralities of beams connects at a beam end portion to the coupler.

9. The support platform of claim 1 wherein the coupler includes a sleeve that clamps to the valve tree.

10. The support platform of claim 1 wherein each beam of the first and second pluralities of beams has a height that is about equal to the distance between the upper and lower floors.

11. A support platform for enabling a worker to service an oil well next to a wellhead having a valve tree, comprising:

a) a platform having an upper floor, a lower floor and a cellar in between the floors;

b) the platform having a periphery, a central opening and a plurality of radially extending beams;

c) a plurality of walls attached to the periphery of the platform, said beams connecting to said walls below said upper floor;

d) a drain that enables fluid to drain from the upper floor to the lower floor;

e) a coupler that occupies the central opening and that spans between the floors, the coupler enabling a connection to be made between the platform and valve tree, the coupler extending above the upper floor and below the lower floor;

f) wherein the plurality of radially extending beams includes a first plurality of beams, each beam of the first plurality attached at one beam end portion to said coupler and at another beam end portion to a platform corner; and g) wherein the plurality of radially extending beams includes a second plurality of beams, each beam of the second plurality of beams attached at one beam end portion to said coupler and at another beam end portion to a platform perimeter beam away from a platform corner.

12. The support platform of claim 11 wherein the first plurality of radially extending beams includes at least four radially extending beams, the platform is generally rectangular, having four corners and wherein four beams of the first plurality each extend to a corner.

13. The support platform of claim 12 wherein multiple beams of the second plurality do not extend to the platform corners.

14. The support platform of claim 11 further comprising a valved drain for draining fluids from the cellar.

15. The support platform of claim 11 wherein the walls extend above and below the upper floor.

16. The support platform of claim 15 wherein the platform is generally rectangular, having four corners and wherein each beam of the second plurality extends to a perimeter beam at a position in between two of said corners.

17. The support platform of claim 16 wherein the first and second plurality of radially extending beams include at least four beams, and four beams extend to the corners and some beams do not extend to corners.

18. The support platform of claim 12 wherein each beam of the first and second pluralities of beams connects at a beam end portion to the coupler.

19. The support platform of claim 11 wherein the coupler includes a sleeve that clamps to the valve tree.

20. The support platform of claim 11 wherein each beam of the first and second pluralities of beams has a height that is about equal to the distance between the upper and lower floors.

21. The support platform of claim 11 wherein the coupler acts as a liquid guard that disallows the escape of fluid from a floor via the central opening.

22. A containment work platform, comprising:

a) an upper floor, a lower floor, and a cellar in between the floors;

b) an opening, interior beams, and a peripheral portion that includes peripheral beams;

c) the peripheral portion of the platform forming a dam around the upper floor, and sealing the cellar at the platform periphery;

d) a drain that enables fluid to drain from the upper floor to the lower floor;

e) a coupler that spans between the floors for enabling a connection to be made between the platform and a valve tree; and f) a liquid guard that disallows the escape of fluid from the upper and lower floors via the opening.

23. The platform of claim 22 further comprising a valved drain for draining fluids from the cellar.

24. The platform of claim 22 wherein the peripheral portion extends above and below the upper floor.

25. The platform of claim 22 wherein the coupler includes a sleeve for clamping to the valve tree.

26. The platform of claim 22 wherein the cellar is capable of receiving any fluid flow that spills upon the upper floor during work or other repair or maintenance operations above the upper floor.

27. The platform of claim 22 wherein the coupler includes threaded studs which project downward.

28. The platform of claim 22 wherein the coupler includes threaded studs which project upward.

29. The platform of claim 22 wherein the coupler includes threaded studs which project upward and downward.

30. The platform of claim 22 wherein the coupler includes an annular flange which projects above the upper floor and below the lower floor, and includes threaded studs which project upward and downward.

31. A containment work platform, comprising:

a) an upper floor, a lower floor, and a cellar in between the floors;

b) a platform periphery, an opening, and beams, each beam having an upper surface connected to the upper floor and a lower surface;

c) wherein the lower floor is spaced below the lower surface of at least some of the beams;

d) a plurality of walls attached to the periphery of the platform;

e) the platform periphery forming a dam around the upper floor, and sealing the cellar at the platform periphery;

f) a drain that enables fluid to drain from the upper floor to the lower floor;

g) a coupler that spans between the floors for enabling a connection to be made between the platform and a valve tree; and h) a liquid guard that disallows the escape of fluid from the upper and lower floors via the opening.

* * * * *